United States Patent [19]

Miyazaki

[11] 4,045,953

[45] Sept. 6, 1977

[54] CIRCUIT BOARD FOR AN ELECTRONIC TIMEPIECE

[75] Inventor: Joichi Miyazaki, Funabashi, Japan

[73] Assignee: Kabushiki Kaisha Daini Seikosha, Japan

[21] Appl. No.: 710,199

[22] Filed: July 30, 1976

Related U.S. Application Data

[63] Continuation-in-part of Ser. No. 615,916, Sept. 23, 1975, abandoned.

[30] Foreign Application Priority Data

Sept. 30, 1974 Japan ..... 49-112490

[51] Int. Cl.[2] ..... G04C 3/00

[52] U.S. Cl. ..... 58/23 R; 58/23 TF

[58] Field of Search ..... 58/23 R, 23 A, 23 TF; 310/8.1, 9.2, 9.4, 9.6

[56] References Cited

U.S. PATENT DOCUMENTS

| | | | |
|---|---|---|---|
| 3,757,510 | 9/1973 | Dill | 58/23 R |
| 3,766,616 | 10/1973 | Staudte | 310/8.2 |
| 3,800,523 | 4/1974 | Yamazaki | 58/23 R |
| 3,842,585 | 10/1974 | Zupoli | 58/23 R |
| 3,909,639 | 9/1975 | Kawai | 310/8.2 |

*Primary Examiner*—Robert K. Schaefer
*Assistant Examiner*—Vit W. Miska
*Attorney, Agent, or Firm*—Robert E. Burns; Emmanuel J. Lobato; Bruce L. Adams

[57] ABSTRACT

A circuit board assembly for an electronic timepiece comprises a lower substrate having at least two recesses therein, an upper substrate superposed on the lower substrate and having at least two openings lying in registry with respective ones of the recesses, and a cover member superposed on the upper substrate hermetically covering the openings to thereby define at least two hermetically sealed compartments. An oscillator is housed in the one compartment and an IC chip housed in the other, both the oscillator and IC chip being electrically connected to electrodes printed on the upper face of the lower substrate. The compartment housing the oscillator is preferably maintained under vacuum and the compartment housing the IC chip is preferably maintained in an atmosphere of nitrogen gas or filled with resin material.

8 Claims, 10 Drawing Figures

FIG. 5
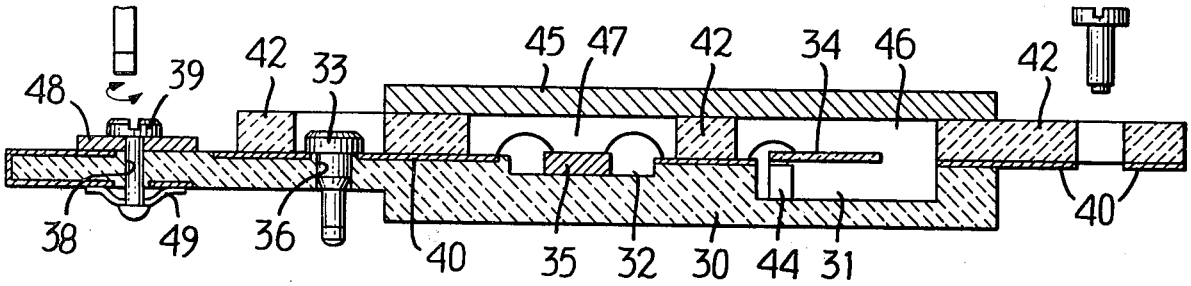
FIG. 6
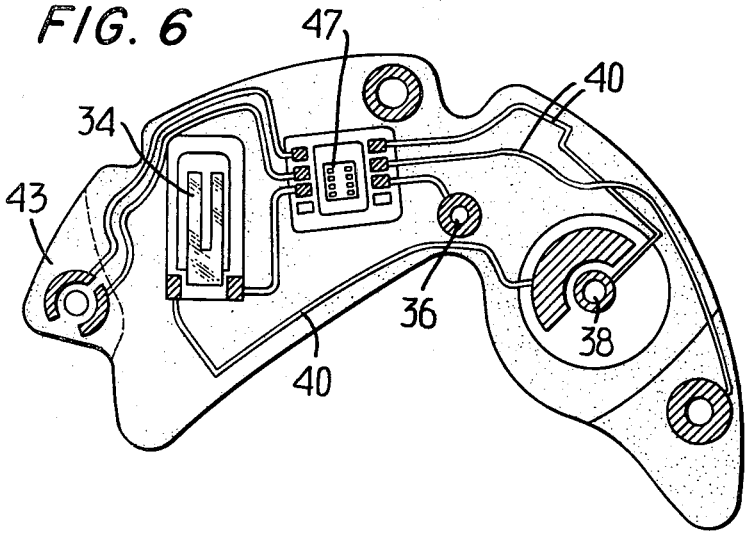
FIG. 7
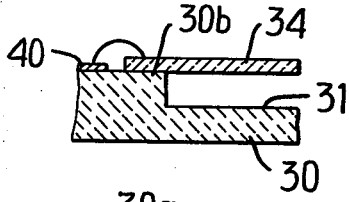
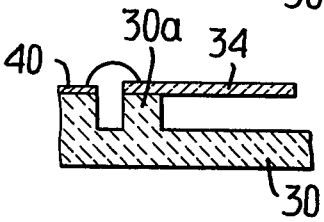
FIG. 8
FIG. 9
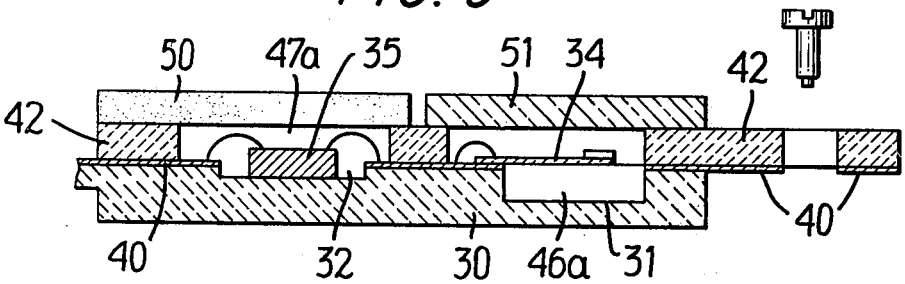
FIG. 10
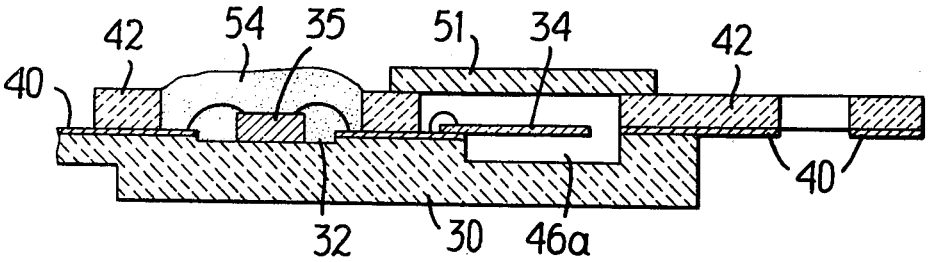

CIRCUIT BOARD FOR AN ELECTRONIC TIMEPIECE

CROSS-REFERENCE TO RELATED APPLICATION

This application is a continuation-in-part of application Ser. No. 615,916 filed Sept. 23, 1975, now abandoned.

BACKGROUND OF THE INVENTION

This invention relates generally to a circuit board assembly for an electronic timepiece and more particularly, to a circuit board assembly having a plurality of compartments for individually housing electronic components such as an oscillator, an IC chip, etc.

In the conventional type circuit board assembly for an electronic timepiece, as shown in FIG. 1, the circuit board 10 contains a printed pattern of electrodes 2 on one or both sides thereof, a terminal pin 3 for connection to a switch, and a set of openings or recesses 10A for housing an IC package 8 and a trimmer capacitor 4. An oscillator unit 7 is mounted on the circuit board 1 and connected by pins 5 to the electrodes 2. By such a construction, the electronic components, such as the IC package 8, trimming capacitor 4 and oscillator unit 7, are fixed to the circuit board 10 by separate connecting steps thereby making it difficult to simplify the assembly of the various electronic circuits. Furthermore, since the thickness of the circuit board is increased due to the mounting of the components on the sides thereof, it is difficult to employ such a circuit board to make a thin electronic watch.

FIG. 2 shows another prior art type circuit board assembly for an electronic timepiece. In this construction, an oscillator 21 and an IC chip 22 are closely housed or packaged in the same compartment 23 and though this results in a small size construction, it is difficult to wirebond the oscillator 21 and the IC chip 22. In addition, this type construction is relatively fragile and hence the components are apt to break if a mechanical shock is imparted to the watch. Moreover, it is inconvenient to carry in stock a supply of circuit boards in the incomplete or partly assembled state, such as shown in FIG. 3, because the IC chip 22 is apt to be damaged if it is touched by mistake, and will deteriorate by being exposed to the open air.

Another conventional type circuit board assembly is shown in FIG. 4. In this modification, the oscillating frequency of an oscillator in the form of a quartz crystal vibrator 24 is adjusted to a predetermined resonant frequency in a known manner by applying thereto a laser beam through the transparent portion 25 of a case 26. An IC chip 27 is mounted with the vibrator 24 in the same compartment and therefore the IC chip is apt to be damaged by the laser beam during the adjustment of the vibrator resonant frequency.

SUMMARY OF THE INVENTION

An object of the present invention is to provide a circuit board assembly for an electronic timepiece having a plurality of compartments in which an oscillator and an IC chip are separately mounted and packaged.

Another object of the present invention is to provide a circuit board assembly for an electronic timpiece and which has means to enable rapid attachment of a trimmer capacitor and a terminal pin for a reset switch.

A further object of the present invention is to provide a circuit board assembly for an electronic timepiece having at least two cover members for covering separate compartments so that each compartment can be maintained at a different atmosphere, for example, the compartment housing the oscillator may be maintained under a vacuum and the compartment housing the IC chip may be maintained in nitrogen gas.

A still further object of the present invention is to provide a compact and reliable circuit board assembly for an electronic timepiece and which can be easily produced at low cost and uses fewer parts than comparable prior art circuit board assemblies.

The foregoing and other objects are achieved by a circuit board assembly comprised of a lower substrate having at least two recesses therein, an upper substrate superposed on the lower substrate and having at least two openings in registry with respective ones of the recesses, and a cover member superposed on the upper substrate covering the openings to thereby define at least two hermetically sealed compartments. An oscillator is housed in one compartment and an IC chip housed in the other. The cover member may be formed as a single cover member or two separate cover members, and the compartments can be filled with the same or different atmospheres.

Having in mind the above and other objects, features and advantages of the invention that will be evident from an understanding of this disclosure, the present invention comprises a printed circuit board assembly as illustrated in the presently preferred embodiments of the invention which are hereinafter set forth in sufficient detail to enable those persons skilled in the art to clearly understand the function, operation and advantages of it when read in conjunction with the accompanying drawings.

BRIEF DESCRIPTION OF THE DRAWINGS

FIG. 5 is a cross-sectional view of one embodiment of circuit board assembly according to this invention;

FIG. 6 is a plan view of the circuit board assembly of FIG. 5 having various electronic components mounted thereon;

FIG. 7 and FIG. 8 are enlarged cross-sectional views of two modifications showing the connection of the oscillator to the circuit board;

FIG. 9 is a cross-sectional view of another embodiment of circuit board assembly according to this invention; and FIG. 10 is a cross-sectional view of a further embodiment of circuit board assembly according to this invention.

DETAILED DESCRIPTION OF PREFERRED EMBODIMENTS OF THE INVENTION

Figure 1:
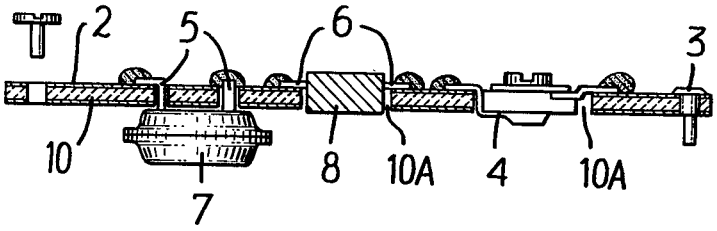
FIG. 1 PRIOR ART
FIG. 1 is a cross-sectional view of a conventional prior art type circuit board assembly.
Figure 2:
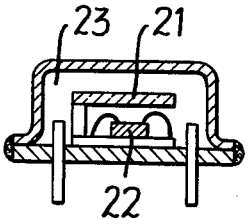
FIG. 2 PRIOR ART
FIG. 2 is a cross-sectional view of a packaged prior art type circuit board assembly.
Figure 3:
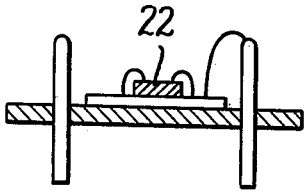
FIG. 3 PRIOR ART
FIG. 3 is a cross-sectional view of the circuit board shown in FIG. 2 showing the same in its partly assembled state.
Figure 4:
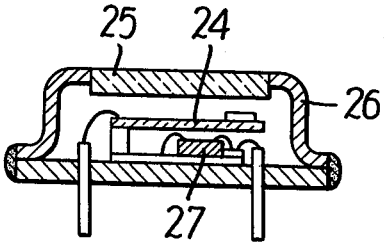
FIG. 4 PRIOR ART
FIG. 4 is a cross-sectional view of another packaged prior art type circuit board assembly having a transparent case portion.

One embodiment of circuit board assembly is shown in FIGS. 5 and 6 and comprises a lower substrate 30 made of ceramics and being provided with at least two recesses 31, 32 for individually and separately housing an oscillator 34 and an IC chip 35. In order to avoid the detrimental influence of the laser beam to the IC chip during setting of the oscillator resonant frequency, a sufficient distance is maintained between recesses 31 and 32.

The peripheral shape of the lower substrate 30 corresponds to the shape of the intended watch case. The lower substrate 30 is also provided with a hole 36 for receiving a terminal pin 33 of a reset switch and a hole 38 for receiving a central pin 39 of a trimmer capacitor. Printed electrodes 40 for making the desired electrical connection of the electronic components are formed on predetermined portions of the substrate 30.

An upper substrate 42 is superposed over the lower substrate 30 and is likewise made of ceramics. The peripheral shape of the upper substrate 42 corresponds to that of the lower substrate 30 and the upper substrate 42 has openings therethrough positioned to overlie the recesses 31, 32 in the lower substrate when the two substrates are sandwiched together. Electrodes are also printed on predetermined portions of the upper substrate 42 and the electrodes are connected to the terminals of an electromechanical converter 43.

During assembly and after the upper substrate 42 is disposed on the lower substrate 30 so that the openings in the upper substrate are in registry with respective ones of the recesses in the lower substrate, the substrates are pressed together and heated to thereby bond them into one substrate body. The electrodes of the upper substrate 42 and the lower substrate 30 are connected at certain points (not shown) to form an electronic circuit for an electronic timpiece.

After that, the oscillator 34 is mounted on a pedestal 44 which is disposed in the recess 31 and fixed thereon by means of an adhesive. In a similar manner, the IC chip 35 is disposed in the other recess 32. The oscillator 34 and the IC chip 35 are wire-bonded to selected electrodes 40 afterwhich a cover member 45 is superposed on the upper substrate 42 to define compartments 46, 47. As seen in FIG. 5, the compartments are defined by the lower substrate recesses, upper substrate openings, and the cover member which covers the openings. Then the periphery of the cover member 45 is hermetically sealed by means of sealing material so as to hermetically seal the compartments. Also, the compartments 46 and 47 may be maintained in a vacuum or negative pressure state.

In this way, the oscillator 34 and the IC chip 35 are separately housed and packaged in respective vacuum compartments 46 and 47 which are sealed at the same time.

The terminal pin 33 of the reset switch is fixed, as shown, on the electrode 40 of the lower substrate 30. A rotor 48 of the trimmer capacitor is rotatably mounted on the lower substrate electrode 40 by a spring member 49 coacting with the central pin 39. As known in the art, the capacitance value of the trimmer capacitor is selectively adjusted by rotating the pin 39 by means of a screwdriver or the like.

It is to be noted that the pedestal 44 serving as a supporting member for the oscillator 34 may be formed by a projection **30*a* which projects from the lower substrate 30 as shown in FIG. 8. Alternatively, the oscillator 34 can be mounted on a step portion 30b adjacent the recess 31 of the lower substrate 30 as shown in FIG. 7.**

Modifications may be made, for example, such as shown in FIG. 9, wherein the cover member is composed of at least two separate cover members 50, 51 which are respectively disposed over the recesses 32, 31. Since each compartment has a separate cover member, each compartment can be sealed in a different atmosphere for example, the compartment **46*a* which houses the oscillator 34 can be under vacuum, and the compartment 47*a* which houses the IC chip 35** can be in an atmosphere of nitrogen gas.

In the FIG. 9 embodiment, only the cover member 51 need be made of transparent material to pass therethrough the laser beam. Since the compartment **47*a* is spaced from the compartment 46*a*, the IC chip 35** is not susceptible to damage by the laser beam.

As mentioned above, according to the present invention, since the oscillator 34 and the IC chip 35 are packaged separately and simultaneously, the need for separately encasing or packaging the oscillator 34 and the IC chip 35 is effectively eliminated.

Moreover, since the space needed for housing the oscillator, IC chip and other electronic components is increased as compared to prior art constructions, the wire bonding and other assembling steps can be more easily carried out.

Further, since the trimmer capacitor is formed in one piece on the lower substrate 30, no special means is needed for fixing the trimmer capacitor.

Furthermore, according to the present invention, since the cover member can be dividied into at least two pieces and the oscillator and IC chip can be separately packaged, the production yield and the work efficiency is markedly improved.

FIG. 10 shows another embodiment wherein instead of keeping the compartment for the IC chip in vacuum, the recess 32 having mounted therein the IC chip 35 is filled with a resin material 54. In other respects, this embodiment is like that of FIG. 9.

While the invention has been disclosed with reference to several preferred embodiments, it is understood that many modifications thereof and changes thereto will become apparent to those ordinarily skilled in the art and the present invention is intended to cover all such obvious modifications and changes which fall within the spirit and scope of the invention as defined in the appended claims.

What I claim is:

1. A circuit board assembly for an electronic timepiece comprising: a lower substrate having at least two recesses therein; an upper substrate superposed on and connected to said lower substrate and having at least two openings in registry with respective ones of said recesses; covering means hermetically covering said openings to define at least two hermetically sealed compartments; an oscillator mounted in one of said compartments; an IC chip mounted in another of said compartments; and means defining a pattern of electrodes on at least one of said upper and lower substrates in electrical connection with said oscillator and said IC chip.

2. A circuit board assembly according to claim 1; wherein said two hermetically sealed compartments are under vacuum.

3. A circuit board assembly according to claim 1; wherein said two hermetically sealed compartments are maintained in different atmospheres.

4. A circuit board assembly according to claim 3; wherein said compartment in which is mounted said oscillator is in an atmosphere of vacuum; and said compartment in which is mounted said IC chip is in an atmosphere of nitrogen gas.

5. A circuit board assembly according to claim 1; wherein said compartment in which is mounted said IC chip is filled with resin material.

6. A circuit board assembly according to claim 1; wherein said covering means comprises a single cover member hermetically connected to said upper substrate.

7. A circuit board assembly according to claim 1; wherein said covering means comprises two separate covering members each hermetically connected to said upper substrate and covering one of said openings.

8. A circuit board assembly according to claim 1; further including a trimmer capacitor mounted on said lower substrate and electrically connected to selected ones of said electrodes.

* * * * *